US012385117B2

(12) United States Patent
Sung et al.

(10) Patent No.: US 12,385,117 B2
(45) Date of Patent: Aug. 12, 2025

(54) CHROMIUM STEEL SHEET HAVING EXCELLENT CREEP STRENGTH AND HIGH TEMPERATURE DUCTILITY AND METHOD OF MANUFACTURING SAME

(71) Applicant: POSCO, Pohang-si (KR)

(72) Inventors: Hyun-Je Sung, Pohang-si (KR); Sung-Joon Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 775 days.

(21) Appl. No.: 17/626,670

(22) PCT Filed: Aug. 25, 2020

(86) PCT No.: PCT/KR2020/011296

§ 371 (c)(1),
(2) Date: Jan. 12, 2022

(87) PCT Pub. No.: WO2021/054631

PCT Pub. Date: Mar. 25, 2021

(65) Prior Publication Data

US 2022/0259708 A1 Aug. 18, 2022

(30) Foreign Application Priority Data

Sep. 17, 2019 (KR) ..... 10-2019-0114344

(51) Int. Cl.
*C22C 38/54* (2006.01)
*C21D 8/02* (2006.01)
(Continued)

(52) U.S. Cl.
CPC ..... *C22C 38/54* (2013.01); *C21D 8/0226* (2013.01); *C21D 9/46* (2013.01); *C22C 38/001* (2013.01);
(Continued)

(58) Field of Classification Search
CPC ..... C21D 2211/002; C21D 2211/008; C21D 6/00; C21D 8/0226; C21D 8/04;
(Continued)

(56) References Cited

U.S. PATENT DOCUMENTS 6,379,611 B1 4/2002 Komai et al.
6,514,359 B2 * 2/2003 Kawano ..... C22C 38/22 148/333
(Continued)

FOREIGN PATENT DOCUMENTS

CN 101668872 A 3/2010
CN 102690996 A 9/2012
(Continued)

OTHER PUBLICATIONS

International Search Report dated Feb. 10, 2021 issued in International Patent Application No. PCT/KR2020/011296 (with English translation).
(Continued)

*Primary Examiner* — Jie Yang
(74) *Attorney, Agent, or Firm* — Morgan Lewis & Bockius LLP

(57) ABSTRACT

Provided are a chromium steel sheet having excellent creep strength and high-temperature ductility, and a method for manufacturing same. The present invention relates to a chromium steel sheet having excellent creep strength and high-temperature ductility comprising, in percentage by weight: C: 0.04 to 0.15%; Si: 0.5% or less (excluding 0%); Mn: 0.1 to 0.6%; S: 0.01% or less (excluding 0%); P: 0.03% or less (excluding 0%); Cr: 1.9 to 2.6%, Mo: 0.05 to 1.5%; W: 1.4 to 2.0%, V: 0.4 to 1.0%; Ni: 0.4% or less (excluding 0%); Nb: 0.10% or less (excluding 0%); Ti: 0.10% or less (excluding 0%); N: 0.015% or less (excluding 0%); Al:
(Continued)

0.06% or less (excluding 0%); B: 0.007% or less (excluding 0%); and the balance being Fe and inevitable impurities.

11 Claims, 5 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C21D 2211/002* (2013.01); *C21D 2211/008* (2013.01)

(58) Field of Classification Search
CPC ..... C21D 9/46; C22C 38/001; C22C 38/002; C22C 38/02; C22C 38/04; C22C 38/06; C22C 38/44; C22C 38/46; C22C 38/48; C22C 38/50; C22C 38/54
See application file for complete search history.

(56) References Cited

U.S. PATENT DOCUMENTS

| | | | |
|---|---|---|---|
| 2001/0035235 | A1 | 11/2001 | Kawano |
| 2010/0089501 | A1 | 4/2010 | Danielsen et al. |
| 2011/0017356 | A1 | 1/2011 | Kou |
| 2014/0124101 | A1 | 5/2014 | Suwa et al. |
| 2015/0114525 | A1 | 4/2015 | Valls Angles |
| 2019/0352754 | A1 | 11/2019 | Kim et al. |
| 2020/0080178 | A1 | 3/2020 | Choi et al. |
| 2020/0173001 | A1 | 6/2020 | Wang et al. |

FOREIGN PATENT DOCUMENTS

| | | | |
|---|---|---|---|
| CN | 103459645 | A | 12/2013 |
| CN | 104271775 | A | 1/2015 |
| CN | 109266971 | A | 1/2019 |
| CN | 110062814 | A | 7/2019 |
| CN | 110191972 | A | 8/2019 |
| EP | 3372702 | A1 | 9/2018 |
| JP | 2000-204434 | A | 7/2000 |
| JP | 2001-131682 | A | 5/2001 |
| JP | 2001-342549 | A | 12/2001 |
| JP | 2002-194485 | A | 7/2002 |
| JP | 2003-193178 | A | 7/2003 |
| JP | 2003-286543 | A | 10/2003 |
| JP | 2004-143504 | A | 5/2004 |
| JP | 2007-162112 | A | 6/2007 |
| JP | 2008-266786 | A | 11/2008 |
| JP | 2009-180649 | A | 8/2009 |
| KR | 10-2001-0100856 | A | 11/2001 |
| KR | 10-2018-0075659 | A | 7/2018 |
| KR | 10-2019-0035024 | A | 4/2019 |
| WO | 2015/064128 | A1 | 5/2015 |

OTHER PUBLICATIONS

Office Action issued Apr. 25, 2023 for counterpart Japanese Patent Application No. 2022-516186.
Chinese Office Action dated May 7, 2022 issued in Chinese Patent Application No. 202080058632.7 (with English translation).
X. Cheng, et al., "Design and Control of Austenitic Steel," National Defense Industry Press, Jul. 31, 2005, (English Abstract).

* cited by examiner

【FIG. 1】
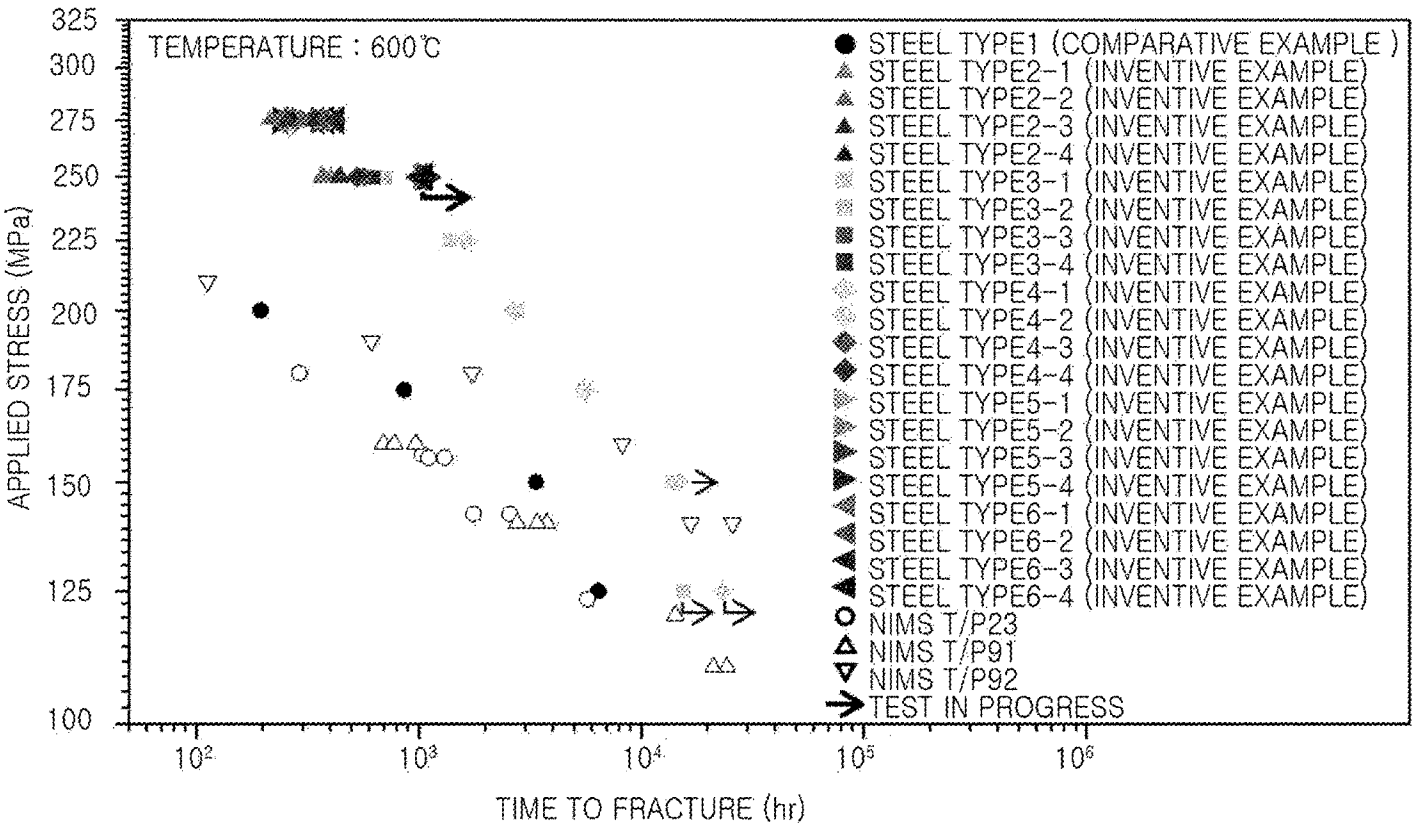

【FIG. 2】
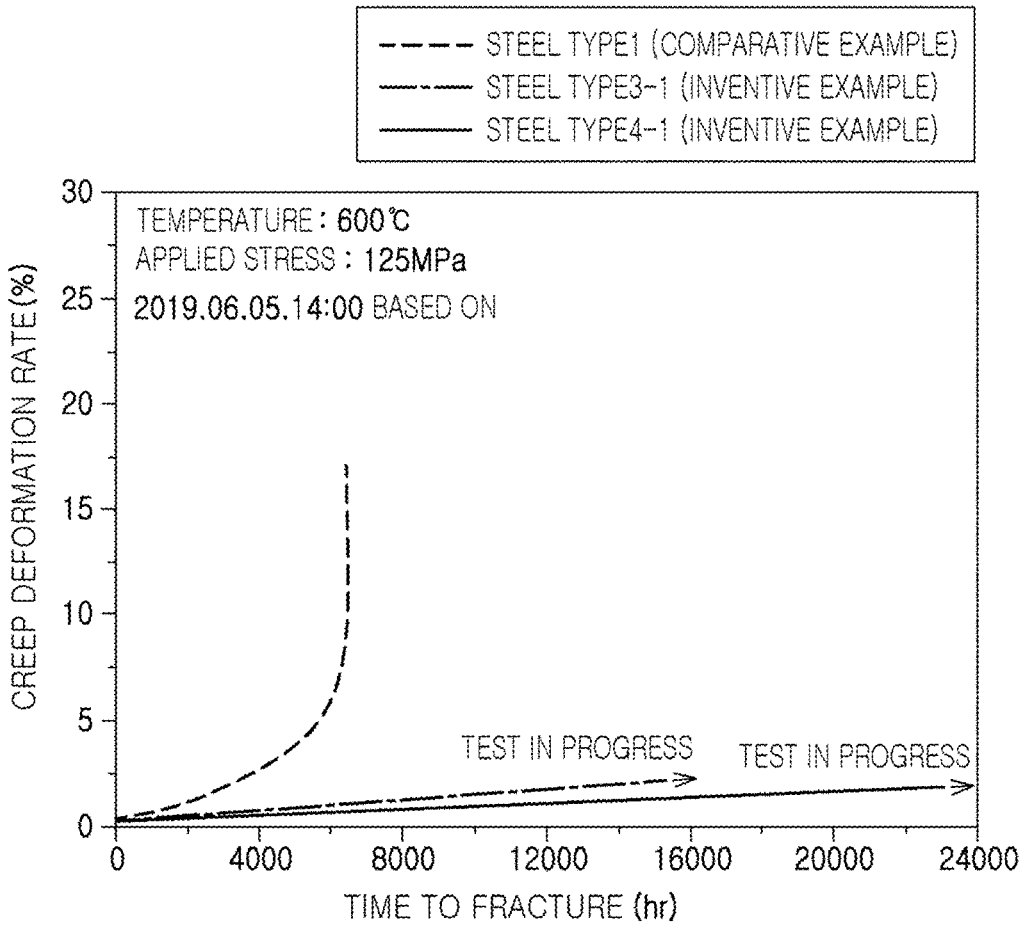

【FIG. 3】
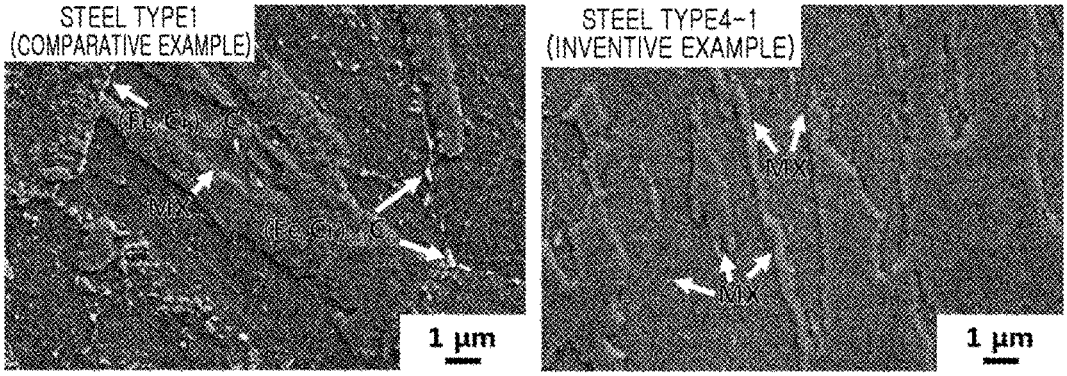
【FIG. 4】
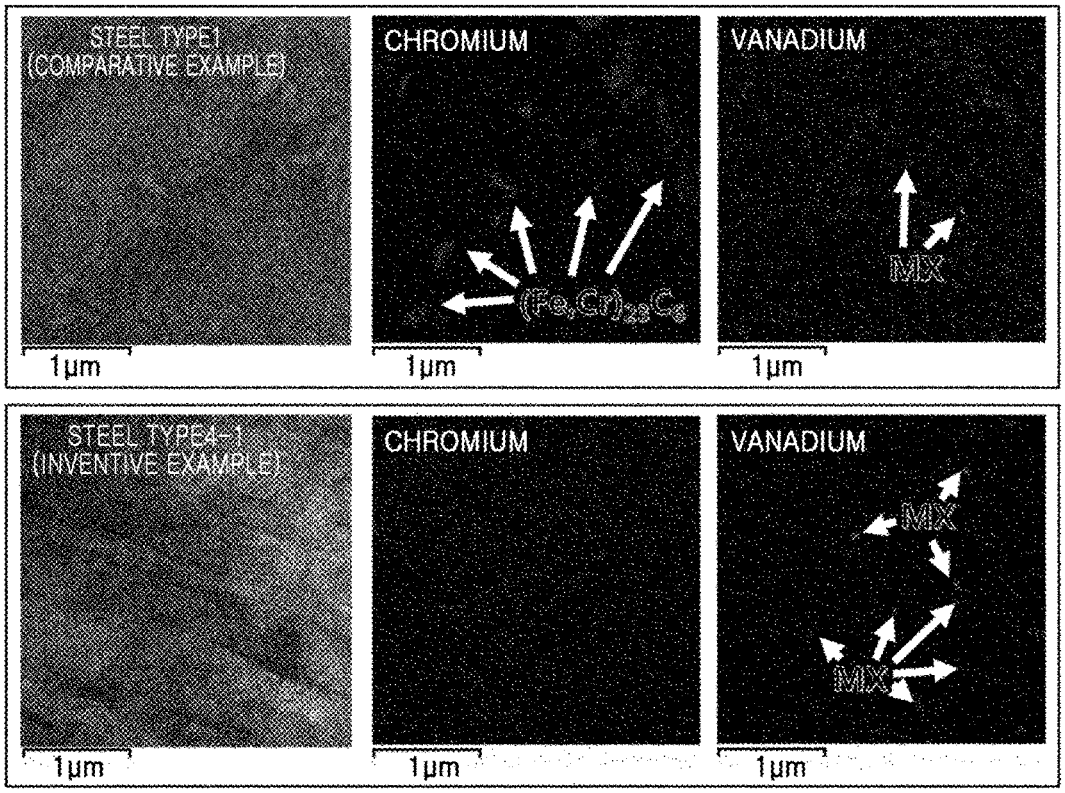

【FIG. 5】
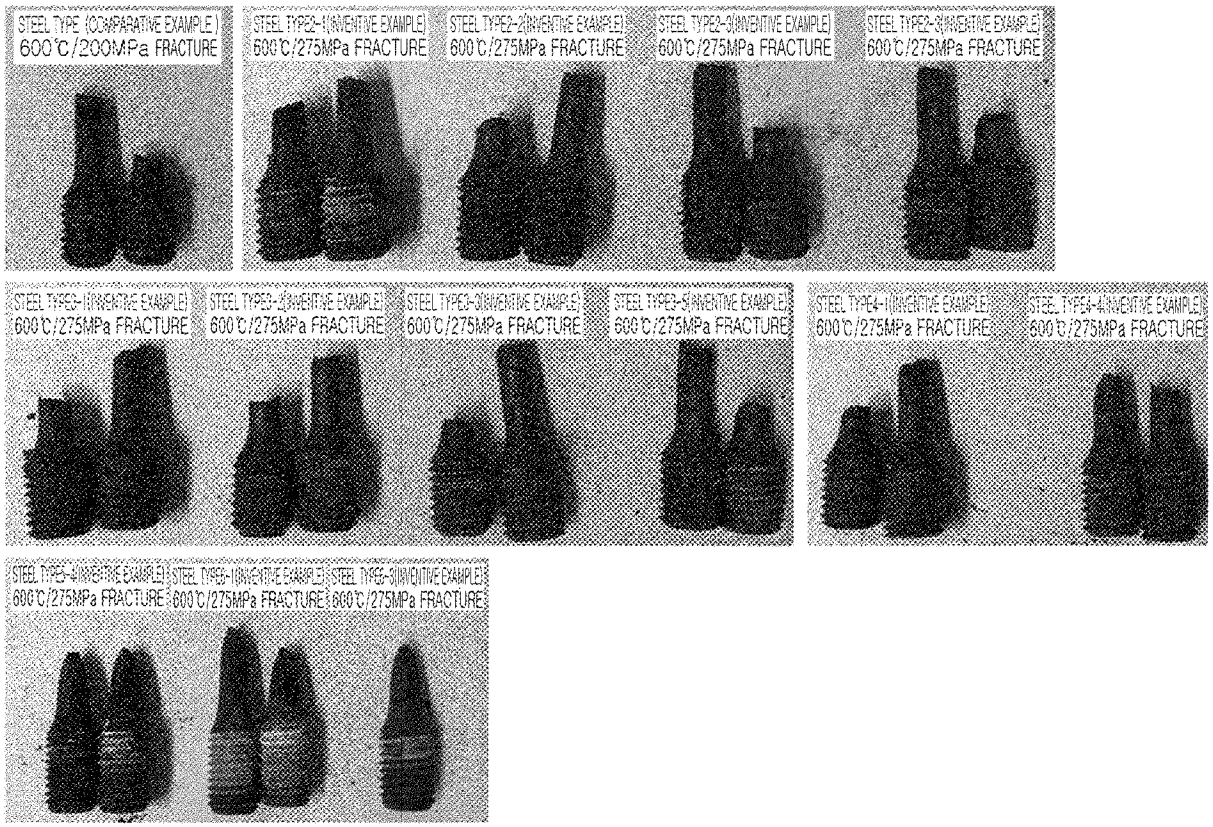

【FIG. 6】
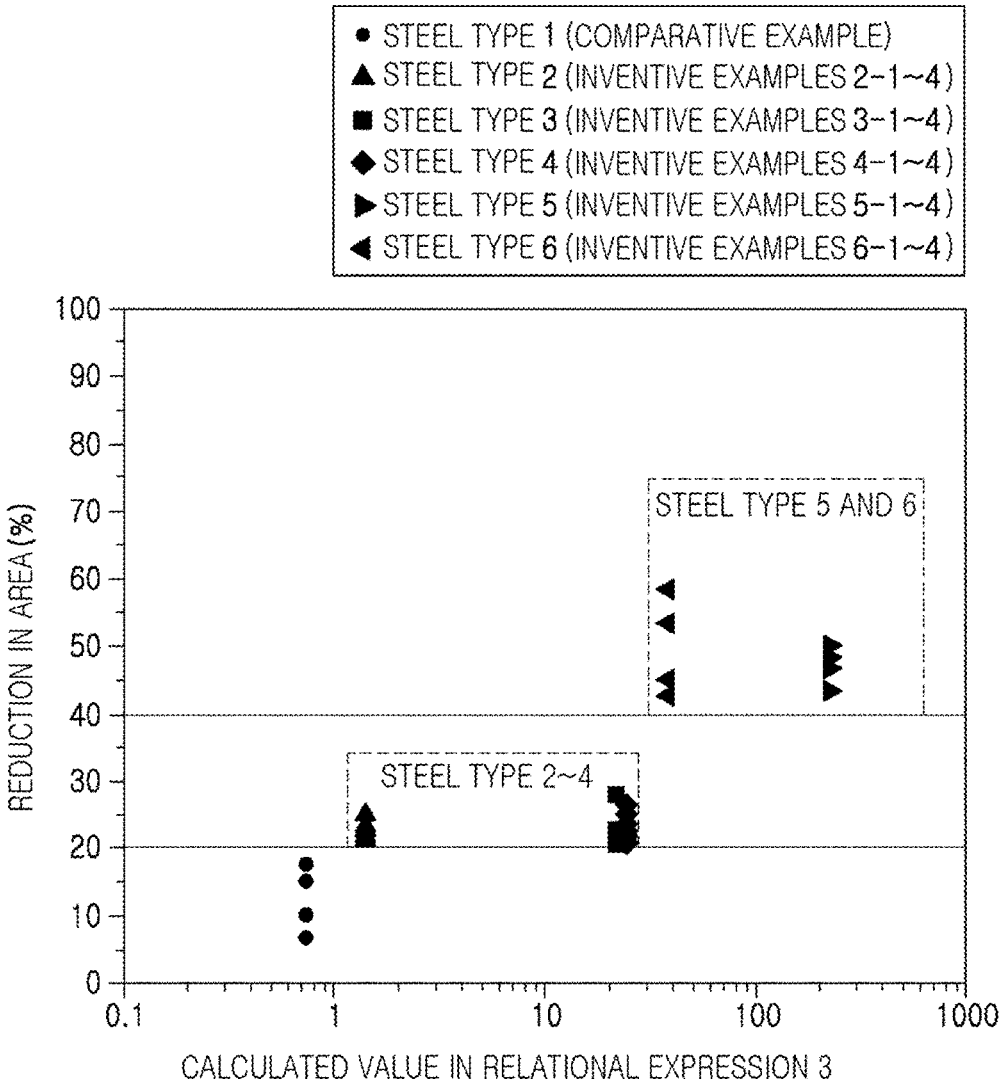

CHROMIUM STEEL SHEET HAVING EXCELLENT CREEP STRENGTH AND HIGH TEMPERATURE DUCTILITY AND METHOD OF MANUFACTURING SAME

CROSS-REFERENCE OF RELATED APPLICATIONS

This application is the U.S. National Phase under 35 U.S.C. § 371 of International Patent Application No. PCT/KR2020/011296, filed on Aug. 25, 2020, which in turn claims the benefit of Korean Application No. 10-2019-0114344, filed on Sep. 17, 2019, the entire disclosures of which applications are incorporated by reference herein.

TECHNICAL FIELD

The present disclosure relates to a chromium steel sheet having excellent creep strength and high-temperature ductility, and a method of manufacturing the same, and more particularly, to a chromium steel sheet which may not only have excellent creep strength by precipitating only fine carbonitrides inside a martensite/bainite microstructure and a grain boundary, which are constituent phases of a steel material through an element alloy, but also reduce crack sensitivity by exhibiting excellent high-temperature ductility, and a method of manufacturing the same.

BACKGROUND ART

Considerations in thermal/nuclear power generation and oil refinery/refining industries are the construction of environmentally friendly facilities and greater efficiency in energy use. First, an increase in temperature and pressure of steam supplied to a turbine for increasing power generation efficiency is required, and thus, improvement of thermal resistance of boiler materials to produce steam at a higher temperature is essential. In addition, in the oil refinery/refining industries also, steel materials having excellent properties at raised temperature are being developed for higher efficiency due to recent strengthening of environmental regulation.

Among steels applied to high temperatures, austenitic stainless steel, containing a large amount of expensive alloying elements, having poor physical properties such as low thermal conductivity and a high coefficient of thermal expansion, so use thereof is limited due to difficulties in manufacturing large components. On the other hand, chrome steel is widely used for the excellent creep strength, weldability, corrosion resistance and oxidation resistance thereof. In the case of nuclear power generation, stability is being secured by replacing austenitic stainless steel with chromium steel, which can ensure long-term soundness, to prevent swelling caused by neutron irradiation.

In order to maintain high-temperature creep strength of heat-resistant chromium steel for a long time, solid solution strengthening and precipitation strengthening methods are applied. To this end, solid solution strengthening elements and M(C,N) carbonitride (M=metal element, C=carbon, N=nitrogen) forming elements are mainly alloyed with vanadium, niobium, and titanium. At the same time, by extremely reducing a carbon content to 0.002% by weight so as to suppress the formation of $(Fe, Cr)_{23}C_6$ carbide which is thermodynamically unstable and easily coarsens, and deteriorates creep strength properties, heat-resistant steel with significantly improved creep strength properties by precipitating fine carbonitrides has also been proposed, but it is almost impossible to mass-produce heat-resistant steel with a lower carbon content as described above. In addition, it is important to reduce formation of surface cracks that may occur during continuous casting or welding in a process of producing steel types, and it is possible to effectively reduce a frequency of cracks when the high-temperature ductility of the material is increased. Therefore, it is essential to design an alloy for developing a steel material having excellent creep strength considering high-temperature ductility and a method of manufacturing the same.

DISCLOSURE

Technical Problem

An aspect of the present disclosure is to provide a chromium steel sheet having excellent creep strength and high-temperature ductility by completely suppressing formation of coarse precipitates such as $(Fe, Cr)_{23}C_6$ carbides and forming only fine carbonitrides without extremely lowering a carbon content, to have excellent creep strength, as well as reducing crack sensitivity due to excellent high-temperature ductility, to widen a range of material application, unlike the conventional technologies described above, using alloy design and heat treatment, and a method for manufacturing the same.

However, the object of the present disclosure is not limited to the object described above, and other objects which are not described above may be clearly understood by those skilled in the art from the following description.

Technical Solution

According to an aspect of the present disclosure, a chromium steel sheet having excellent creep strength and high-temperature ductility includes, in percentage by weight: C: 0.04 to 0.15%; Si: 0.5% or less (excluding 0%); Mn: 0.1 to 0.6%; S: 0.01% or less (excluding 0%); P: 0.03% or less (excluding 0%); Cr: 1.9 to 2.6%, Mo: 0.05 to 1.5%; W: 1.4 to 2.0%, V: 0.4 to 1.0%; Ni: 0.4% or less (excluding 0%); Nb: 0.10% or less (excluding 0%); Ti: 0.10% or less (excluding 0%); N: 0.015% or less (excluding 0%); Al: 0.06% or less (excluding 0%); B: 0.007% or less (excluding 0%); and the balance being Fe and inevitable impurities, wherein the chromium steel sheet satisfies Relational Expression 1, and has an LMP value defined by Relational Expression 2 of 20,000 or more at an applied stress of 200 MPa and 21,000 or more at an applied stress of 125 MPa, and a reduction in area at high temperature fracture is 20% or more.

$$0.3 \leq (V-10SUM) \leq 1 \quad \text{[Relational Expression 1]}$$

where, SUM is a total content of specific impurity elements, specifically, Cu+Co+La+Y+Ce+Zr+Ta+Hf+Re+Pt+Ir+Pd+Sb.

$$LMP = T \times (20 + \log(tr)) \quad \text{[Relational Expression 2]}$$

where, T is an absolute temperature in Kelvin units, and tr is a fracture time in time units.

The steel sheet may have a chemical composition that satisfies the following Relational Expression 3, and at the same time, an LMP value defined by Relational Expression 2 at an applied stress of 250 MPa of 20,000 or more, and a reduction in rate of 40% or more at high temperature fracture.

$$35 \leq |(V-10SUM) \times (Mo-10SUM) \times (Ni-10SUM) \times 10^3| \leq 600 \quad \text{[Relational Expression 3]}$$

where, SUM is a total content of specific impurity elements, specifically, Cu+Co+La+Y+Ce+Zr+Ta+Hf+Re+Pt+Ir+Pd+Sb.

The steel sheet may have a microstructure including tempered martensite/bainite.

It is preferable the number of precipitates having a diameter of 200 nm or more including $(Fe, Cr)_{23}C_6$ in a range of $1/\mu m^2$ or less in the microstructure of the steel sheet.

It is preferable that the number of precipitates having a diameter of 20 nm or less in a range of $20/\mu m^2$ or more in the microstructure of the steel sheet.

The precipitates having a diameter of 20 nm or less may be (V, Mo, Nb, Ti) (C, N).

According to another aspect of the present disclosure, a method of manufacturing a chromium steel sheet having excellent creep strength and high-temperature ductility, the method includes:

hot rolling a steel slab having the above-described composition so that a finish rolling temperature is equal to or higher than Ar3 to manufacture a hot-rolled steel sheet, and then cooling the hot-rolled steel sheet;

reheating the cooled hot-rolled steel sheet in a temperature range of 1000° C. to 1100° C. for at least 30 minutes to austenitize the steel sheet;

normalizing or quenching the austenitized hot-rolled steel sheet to room temperature at a cooling rate of 0.1° C./s or more; and tempering the cooled hot-rolled steel sheet in a temperature range of 700 to 800° C. for at least 30 minutes.

Advantageous Effects

As set forth above, according to the present disclosure, the chromium steel sheet having excellent creep strength and high-temperature ductility having an LMP value of 20,000 or more at an applied stress of 200 MPa and 21,000 or more at an applied stress of 125 Mpa, having the configuration described above may have a longer creep strength life than an ASTM A213 92 grade steel containing chromium in a large amount of 9 wt %, with an excellent creep strength life at a high temperature, by quenching and tempering, and have a reduction in area at high temperature fracture of 20% or more.

In addition, the chromium steel sheet having an LMP value of 20,000 or more at an applied stress of 250 MPa, and a creep strength life of 1000 hours or more at a temperature of 600° C., which is very excellent, and a reduction in area at high temperature fracture of 40% or more, which is excellent, may be provided.

DESCRIPTION OF DRAWINGS

FIG. 1 is a diagram illustrating a comparison of the results of a creep test for steel types 1 to 6 and conventional materials used in the experiment of the present disclosure.

FIG. 2 is a diagram illustrating creep strain at 600° C. 125 MPa condition according to passage of time measured using an extensometer of steel types 3-1 and 4-1, and steel type 1 which is Comparative Example, used in the experiment of the present disclosure.

FIG. 3 is scanning electron microscope (SEM) photographs for steel type 1 and steel type 4-1 steel sheets used in the experiment of the present disclosure.

FIG. 4 is transmission electron microscope (TEM) photographs of steel types 1 and steel type 4-1 steel sheets used in the experiment of the present disclosure.

FIG. 5 is a photograph of a specimen fractured at 600° C./200 MPa condition of steel type 1 used in the experiment of the present disclosure, and a photograph of a specimen fractured at 600° C./275 MPa condition of steel types 2 to 6.

FIG. 6 is a graph summarizing cross-sectional ratios of steel types 1 to 6 specimens finally fractured by being used in the experiment of the present disclosure.

BEST MODE FOR INVENTION

Hereinafter, the present disclosure will be described.

As described above, a conventional thermal resistant chromium steel mainly uses molybdenum and vanadium, niobium, and titanium which are elements forming M(C, N) carbonitrides (M=metal element, C=carbon, N=nitrogen), but the thermal resistant chromium steel as such is thermodynamically unstable and easily coarsened so that formation of $(Fe, Cr)_{23}C_6$ carbides which deteriorate creep properties may not be avoided, and thus, it is difficult to secure excellent creep properties.

In order to solve the problems of the conventional technology, the present inventors repeated studies and experiments, and as a result, confirmed that by optimizing an amount of vanadium, molybdenum and nickel in a thermal resistant chromium steel alloy containing 1.9 to 2.6% of Cr, and at the same time optimizing processes such as an austenitization temperature, a cooling rate, and a tempering temperature, a thermal resistant chromium steel having excellent creep properties and high ductility may be obtained, thereby suggesting the present disclosure.

According to an aspect of the present disclosure, a chromium steel sheet having excellent creep strength and high-temperature ductility includes, in percentage by weight: C: 0.04 to 0.15%; Si: 0.5% or less (excluding 0%); Mn: 0.1 to 0.6%; S: 0.01% or less (excluding 0%); P: 0.03% or less (excluding 0%); Cr: 1.9 to 2.6%, Mo: 0.05 to 1.5%; W: 1.4 to 2.0%, V: 0.4 to 1.0%; Ni: 0.4% or less (excluding 0%); Nb: 0.10% or less (excluding 0%); Ti: 0.10% or less (excluding 0%); N: 0.015% or less (excluding 0%); Al: 0.06% or less (excluding 0%); B: 0.007% or less (excluding 0%); and the balance being Fe and inevitable impurities, wherein the chromium steel sheet satisfies relational expression 1, and has an LMP value defined by relational expression 2 of 20,000 or more at an applied stress of 200 MPa and 21,000 or more at an applied stress of 125 MPa, and a reduction in area at high temperature fracture is 20% or more.

$$0.3 \leq (V - 10SUM) \leq 1 \quad \text{[Relational Expression 1]}$$

where, SUM is a total content of specific impurity elements, specifically, Cu+Co+La+Y+Ce+Zr+Ta+Hf+Re+Pt+Ir+Pd+Sb.

$$LMP = T \times (20 + \log(tr)) \quad \text{[Relational Expression 2]}$$

where, T is an absolute temperature in Kelvin units, and tr is a fracture time in time units.

Hereinafter, the reason for limiting the components of the chromium steel sheet having excellent creep strength and high-temperature ductility will be described, and "%" herein represents "wt %", unless otherwise defined.

Carbon (C): 0.04 to 0.15%

Carbon is an element for austenite stabilization, which may adjust an Ae3 temperature and a martensite formation initiation temperature depending on the content and is very effective for applying asymmetric distortion as an interstitial element to a lattice structure of a martensite phase to secure high strength. However, when a carbon content in the steel exceeds 0.15%, carbides are excessively formed and weldability is greatly deteriorated, which are disadvantages. Therefore, in the present disclosure, it is preferable to limit the carbon content to a range of 0.04 to 0.15%.

Silicon (Si): 0.5% or less (excluding 0%)

Silicon is added as a deoxidizer during casting as well as for strengthening of solid solution. However, while it is essential to form advantageous carbides such as fine carbides in the chromium steel sheet having excellent creep strength and high-temperature ductility according to an embodiment in the present disclosure, silicon serves to suppress carbide formation. Therefore, it is preferable to limit a silicon content to 0.5% or less in the present disclosure.

Manganese (Mn): 0.1 to 0.6%

Manganese is an element for austenite stabilization, which greatly increases hardenability of steel to allow a hard phase such as martensite to be formed. In addition, manganese reacts with sulfur so that MnS is precipitated, which is advantageous for preventing cracks at a high temperature by sulfur segregation. However, as a manganese content increases, an austenite stability degree is excessively increased. Therefore, it is preferable to limit the manganese content to a range of 0.1 to 0.6%, more preferably to a range of 0.4 to 0.6% in the present disclosure.

Sulfur (S): 0.010% or less (excluding 0%)

Sulfur is an impurity element and when the content exceeds 0.010%, ductility and weldability of steel are deteriorated.

Therefore, it is preferable to limit a sulfur content to 0.010% or less.

Phosphorus (P): 0.03% or less (excluding 0%)

Phosphorus is an element having a solid solution strengthening effect, but an impurity element like sulfur, and when the content exceeds 0.03%, steel has brittleness and decreased weldability.

Therefore, it is preferable to limit a phosphorus content to 0.03% or less.

Chromium (Cr): 1.9 to 2.6%

Chromium is a ferrite stabilization element and an element increasing hardenability, and adjusts an Ae3 temperature and a delta ferrite forming region temperature depending on the amount. In addition, chromium reacts with oxygen to form a dense and stable protective coat of $Cr_2O_3$ to increase oxidation resistance and corrosion resistance at a high temperature, but increases a delta ferrite forming temperature region. In a process of casting steel having a high chromium content, delta ferrite may be formed, and remains even after heat treatment to adversely affect steel material characteristics. Therefore, it is preferable to limit a chromium content to a range of 1.9 to 2.6%, more preferably the chromium content to a range of 2.1 to 2.5% in the present disclosure.

Molybdenum (Mo): 0.05 to 1.5%

Molybdenum increases hardenability, such that it is possible to effectively prevent a problem in which a matrix strength is greatly reduced due to formation of ferrite and pearlite structures. In addition, molybdenum increases a high-temperature creep life at a high temperature by strong solid solution strengthening, participates as a metal element forming M(C,N) carbonitrides to stabilize carbonitrides, and greatly reduces a coarsening speed. In addition, in the present disclosure, it was confirmed that molybdenum as a grain boundary strengthening element can be greatly contribute to an increase in the high-temperature ductility of the material. At least 0.05% of molybdenum should be added, but when molybdenum is also excessively added as an expensive element, manufacturing costs may increase significantly, so it is preferable that molybdenum is added in an amount of 1.5% or less. More preferably, the molybdenum content is limited to a range of 0.2 to 1.4%.

Tungsten (W): 1.4 to 2.0%

Tungsten affects solid solution strengthening to increase a high-temperature creep life, participates as a metal element forming carbonitrides to stabilize the carbonitrides, and greatly reduces a coarsening speed. However, when a tungsten content is increased, a delta ferrite forming temperature region may be widened, such that delta ferrite may be formed in a process of casting steel. Delta ferrite, remaining unremoved even after heat treatment, adversely affects creep properties. Therefore, it is preferable to limit a molybdenum content to a range of 1.4 to 2.0%, more preferably the molybdenum content to a range of 1.5 to 1.8%.

Vanadium (V): 0.4 to 1.0%

Vanadium is one of elements forming M(C, N) carbonitrides, and when a vanadium content is increased, $(Fe, Cr)_{23}C_6$ carbide formation driving force is decreased, resulting in complete suppression of $(Fe, Cr)_{23}C_6$ carbide formation. In order to suppress $(Fe, Cr)_{23}C_6$ carbide formation in steel having a chromium content of 1.9 to 2.6%, a tungsten content of 1.4 to 2.0%, and a molybdenum content of 0.05 to 1.5%, 0.4% or more of a vanadium alloy is needed. However, when a vanadium content exceeds 1.0%, there is a difficulty in a production process of materials. Therefore, it is preferable to limit the vanadium content to a range of 0.40 to 1.0%, more preferably to a range of 0.5 to 0.9%.

Nickel (Ni): 0.4% or less (excluding 0%)

Nickel is an element for improving toughness of steel and is added for increasing steel strength without deterioration of toughness at a low temperature. In addition, when nickel is added, by increasing hardenability, it is possible to effectively prevent a problem that a matrix strength is greatly reduced due to formation of ferrite and pearlite structures. In addition, nickel (Ni) is a grain boundary strengthening element, which can greatly contribute to an increase of the high-temperature ductility of the material. If a nickel content exceeds 0.4%, it causes a price increase due to addition of nickel.

Therefore, it is preferable to limit the nickel content to 0.4% or less.

Niobium (Nb): 0.01% or less (excluding 0%)

Niobium is one of elements forming M(C, N) carbonitrides. In addition, it is solid-solubilized when reheating a slab and suppresses austenite crystal grain growth during hot rolling, and then is precipitated to improve steel strength. However, when niobium is excessively added at more than 0.10%, weldability may be deteriorated, and crystal grains may be micronized than necessary.

Therefore, it is preferable to limit a niobium content to 0.10% or less.

Titanium (Ti): 0.10% or less (excluding 0%)

Titanium is also an element effective for suppressing austenite crystal grain growth in a TiN form. However, when titanium is added at more than 0.10%, coarse Ti-based precipitates are formed and there is a difficulty in welding of materials.

Therefore, it is preferable to limit a titanium content to 0.10% or less.

Nitrogen (N): 0.015% or less (excluding 0%)

Since it is difficult to industrially completely remove nitrogen from steel, an upper limit of N is 0.015% which is a range allowable in a manufacturing process. Nitrogen is known as an austenite stabilization element, and high-temperature stability is greatly increased when forming M(C, N) carbonitrides as compared with simple MC carbides, thereby effectively increasing creep strength of a steel material. However, when the content exceeds 0.015%, nitrogen is bonded to boron to form BN, thereby increasing a risk of defect occurrence.

Therefore, it is preferable to limit a nitrogen content to 0.015% or less.

Aluminum (Al): 0.06% or less (excluding 0%)

Aluminum enlarges a ferrite region, and is added as a deoxidizer during casting. Since in chromium steel, other ferrite stabilization elements are alloyed much, when an aluminum content is increased, an Ae3 temperature may be excessively raised. In addition, when the amount added exceeds 0.06% in a current component system, an oxide-based inclusion is formed in a large amount to inhibit the physical properties of a material.

Therefore, it is preferable to limit an aluminum content to 0.06% or less, more preferably to a range of 0.005 to 0.025%.

Boron (B): 0.007% or less (excluding 0%)

Boron is a ferrite stabilization element and contributes much to a hardenability increase only with a minimum amount. In addition, it is easily segregated in a crystal grain boundary to give a crystal grain boundary strengthening effect. However, when boron is added at more than 0.007%, BN may be formed, which may adversely affect the mechanical properties of materials.

Therefore, it is preferable to limit a boron content to 0.007% or less.

Other than that, a balance of Fe and unavoidable impurities are included. However, since in a common manufacturing process, unintended impurities may be inevitably incorporated from raw materials or a surrounding environment, the impurities may not be excluded. Since these impurities are known to any person with ordinary knowledge in the art, the entire contents thereof are not particularly mentioned herein.

In this case, it is preferable that the steel sheet of the present disclosure has a chemical composition satisfying the following Relational Expression 1.

$$0.3 \leq (V-10\text{SUM}) \leq 1 \quad \text{[Relational Expression 1]}$$

where, SUM is a total content of specific impurity elements, specifically, Cu+Co+La+Y+Ce+Zr+Ta+Hf+Re+Pt+Ir+Pd+Sb.

That is, the steel in the present disclosure must not only satisfy the condition of V: 0.4 to 1.0%, but also it is necessary to control so that impure elements that may inhibit a beneficial effect of vanadium are not included in the steel of the present disclosure. Specifically, after multiplying the defined 'SUM' by the number 10 and giving weight, when a value obtained by subtracting 10SUM from the content (wt %) of vanadium in steel is 0.4% or more and 1.0% or less, it can be confirmed that the effect of vanadium described in the present disclosure may be obtained, and the present technical configuration may be proposed.

Meanwhile, in the present disclosure, copper (Cu), which is an element constituting the 'SUM', is highly likely to adversely affect surface sporadic cracks of chromium steel. Since cobalt (Co) lowers hardenability, when included in steel, a bainite/martensite structure may not be obtained in a process in which the reheated austenitized hot-rolled steel sheet is normalized or quenched at a cooling rate of 0.1° C./s or more to cool the same to room temperature. Among other residual impurities, when very expensive rare earths are included in the steel type, the price may increase significantly and mechanical properties may deteriorate. Therefore, a sum of weight % of alloy elements that should not be included in the steel type of the present disclosure was defined as SUM.

In the present disclosure, the steel sheet satisfying the above Relational Expression 1, an Larson-Miller Parameter (LMP) value defined by the following Relational Expression 2 may be 20,000 or more at an applied stress of 200 Mpa and 21,000 or more at an applied stress of 125 Mpa, and a reduction in area at high temperature fracture may be 20% or more.

$$LMP = T \times (20 + \log(tr)) \quad \text{[Relational Expression 2]}$$

where, T is an absolute temperature in Kelvin units, and tr is a fracture time in time units.

In addition, it is more preferable that the steel sheet has a chemical composition satisfying the following Relation Expression 3.

$$35|(V-10\text{SUM}) \times (Mo-10\text{SUM}) \times (Ni-10\text{SUM}) \times 10^3| \leq 600$$

where, SUM is a total content of specific impurity elements, specifically, Cu+Co+La+Y+Ce+Zr+Ta+Hf+Re+Pt+Ir+Pd+Sb.

In the present disclosure, the steel sheet satisfying Relational Expression 3 may have an LMP value defined by the Relational Expression 2 of 20,000 or more at an applied stress of 250 MPa, and a reduction in area of 40% or more at high temperature fracture.

In the present disclosure, in order to provide a chromium steel sheet having excellent creep strength and high-temperature ductility having an LMP value of 20,000 or more defined by the Relational Expression 2 and a reduction in area at high temperature fracture of 40% or more, it is preferable to properly control the vanadium content, and the molybdenum and nickel contents. Therefore, impurity elements that may impair a beneficial effect due to addition of these elements should not be included in the steel of the present disclosure, and the above Relational Expression 3 is derived from this point of view.

Hereinafter, a microstructure and precipitates of the chromium steel sheet of the present disclosure having excellent creep strength and high-temperature ductility will be described in detail.

First, the steel sheet of the present disclosure includes a tempered martensite/bainite structure as the matrix microstructure.

It is preferable that the number of precipitates having a diameter of 200 nm or more including $(Fe, Cr)_{23}C_6$ is in a range of one/$\mu m^2$ or less in the steel sheet microstructure of the present disclosure. When the number of precipitates having a diameter of 200 nm or more exceeds one/$\mu m^2$, deteriorated creep properties may be caused by coarse carbides.

On the other hand, it is preferable that the number of precipitates having a diameter of 20 nm or less is in a range of 20/$\mu m^2$ or more in the steel sheet microstructure of the present disclosure. When the number of precipitates having a diameter of 20 nm or less is less than 20/$\mu m^2$, a distance between fine carbonitrides is significantly increased. Therefore, since dislocation movement at a high temperature and movement of sub-crystal grains are not effectively prevented, an effect of improving creep properties may not be large.

The precipitates having a diameter of 20 nm or less in the present disclosure may include (V, Mo, Nb, Ti) (C, N).

Next, a method for manufacturing a precipitation hardening type chromium steel sheet having excellent creep strength according to an embodiment in the present disclosure will be described.

The method for manufacturing a precipitation hardening type chromium-molybdenum steel sheet having excellent creep strength and high-temperature ductility of the present disclosure includes: hot rolling a steel slab having the composition described above so that a finish rolling temperature is equal to or higher than Ar3 to manufacture a hot-rolled steel sheet, and then cooling the hot-rolled steel sheet; reheating the cooled hot-rolled steel sheet in a temperature range of 1000 to 1100° C. for at least 30 minutes to austenitize the steel sheet; normalizing or quenching the austenitized hot-rolled steel sheet to room temperature at a cooling rate of 0.1° C./s or more; and tempering the cooled hot-rolled steel sheet in a temperature range of 700 to 800° C. for at least 30 minutes.

First, in the present disclosure, a steel slab having the composition component described above is hot rolled so that a finish rolling temperature is equal to or higher than Ar3 to obtain a hot-rolled steel sheet. The reason for performing hot rolling in an austenite single phase region is to increase uniformity of a structure.

Then, in the present disclosure, the hot-rolled steel sheet manufactured was cooled to room temperature.

Subsequently, in the present disclosure, the cooled hot-rolled steel sheet is reheated to austenitize the steel sheet. Here, it is preferable that a reheating temperature range is 1000 to 1100° C., and a reheating time is preferably for at least 30 minutes.

When the reheating temperature is lower than 1000° C., it is difficult to correctly redissolve undesired carbides formed in a process of cooling after hot rolling. However, when the reheating temperature is higher than 1100° C., the characteristics may be deteriorated due to crystal grain coarsening.

It is preferable that the reheating be performed for at least 30 minutes. When the reheating time is less than 30 minutes, it is difficult to correctly redissolve undesired carbides formed in a process of cooling after hot rolling.

Then, in the present disclosure, the hot-rolled steel sheet austenitized by the reheating is normalized or quenched to be cooled down to room temperature, thereby obtaining a bainite/martensite structure. Here, when cooling a matrix structure, care should be taken so that ferrite and pearlite structures are formed to greatly decrease matrix strength. Since the steel type of the present disclosure may include elements such as V, Mo, and Ni having high hardenability, when it is normalized or quenched at a cooling rate of 0.1° C./s or more, ferrite and pearlite structures may not be formed. Preferably, an upper limit of the cooling rate is controlled to 50° C./s.

Subsequently, in the present disclosure, the normalized or quenched hot-rolled steel sheet is tempered. Here, it is preferable that a tempering temperature is 700 to 800° C., a tempering time is at least 30 minutes, and then air cooling is performed.

When the tempering temperature is lower than 700° C., precipitation of fine carbonitrides may not be induced in time due to the low temperature. On the other hand, when the tempering temperature is exceeds 800° C., tempering causes softening of materials to greatly decrease a creep strength life. When the tempering time is less than 30 minutes, precipitates to be formed may not be formed.

MODE FOR INVENTION

Hereinafter, the present disclosure will be described in detail through the following Examples.

Example

Hot-rolled steel sheets having alloy compositions of the following Table 1 and a thickness of 12 mm were prepared. Then, the hot-rolled steel sheet was reheated at various temperatures within a range of 1000 to 1100° C. for at least 30 minutes, and normalized or quenched to cool down to room temperature. Subsequently, the cooled steel sheet was tempered at various temperatures within a range of 700 to 800° C. for at least 30 minutes and then air-cooled to room temperature to manufacture a steel sheet. Meanwhile, in the following Table 1, steel type 1 is a general ASTM A213 grade 23 steel composition, and the remaining steel types are all steel types satisfying the steel composition component of the present disclosure. Specifically, steel types 2 to 4 have a chemical composition satisfying Relational Expression 1 but not satisfying Relational Expression 3, and steel types 5 to 6 have a chemical composition simultaneously satisfying both Relational Expression 1 and Relational Expression 3 above.

For the alloy steels prepared as described above, creep specimens having a gauge length of 15 mm and a gauge diameter of 6 mm were respectively prepared by using ASTM E139 standards in a hot rolling direction. The high-temperature creep life was evaluated for the results, and the results were shown in FIG. 1. In addition, for comparison, the creep results of ASTM A213 grades 23, 91, and 92 steel materials provided by the Japan Institute of Materials Research (NIMS) were also shown in FIG. 1. In addition, creep strains of steel types 1, 3-1, and 4-1 were measured using an extensometer, and the results were shown in FIG. 2.

A microstructure of the prepared alloy steel specimen was observed using a scanning electron microscope (SEM), and the results were shown in FIG. 3. A distribution of the precipitates was accurately observed using a transmission electron microscope (TEM) and energy spectroscopy, and the results were shown in FIG. 4.

In addition, a reduction in area (RA) was used as an evaluation measure for whether the steel types showed ductile fractures when they were finally creep fractured at high temperature. When a creep specimen having an initial gauge diameter RO (6 mm) has a diameter of a creep fractured surface at high temperature is R, a reduction in area (RA) is $[(RO-R)/RO]\times100$. The microstructure of steel types, creep test conditions (temperature and stress), fracture time and reduction in area (RA) are shown in Table 2 below, and a photograph of a specimen that can intuitively compare the reduction in area (RA) of an actual fracture material is shown in FIG. 5. In the Table 1 below, a sulfur content of all steel types is 30 ppm or less, a boron content is 70 ppm or less (excluding 0%), and the remaining components are Fe and unavoidable impurities.

TABLE 1

| Steel type No. | Heat treatment | Steel composition component in weight % | | | | | | | | | | | | | | |
|---|---|---|---|---|---|---|---|---|---|---|---|---|---|---|---|---|
| | | C | Si | Mn | P | Cr | Mo | W | Ni | Nb | Ti | V | N | Al | A* | B* |
| 1 | 1000N 700T | 0.10 | 0.32 | 0.51 | 0.02 | 2.24 | 0.05 | 1.55 | 0.01 | 0.05 | 0.02 | 0.26 | 0.01 | 0.02 | 0.16 | 0.72 |
| 2-1 | 1000N 700T | 0.10 | 0.32 | 0.51 | 0.02 | 2.24 | 0.05 | 1.54 | 0.01 | 0.05 | 0.02 | 0.41 | 0.01 | 0.02 | 0.31 | 1.395 |
| 2-2 | 1100N 800T | | | | | | | | | | | | | | | |
| 2-3 | 1000Q 700T | | | | | | | | | | | | | | | |
| 2-4 | 1100Q 800T | | | | | | | | | | | | | | | |
| 3-1 | 1000N 700T | 0.10 | 0.32 | 0.53 | 0.02 | 2.24 | 0.05 | 1.51 | 0.03 | 0.05 | 0.01 | 0.62 | 0.01 | 0.02 | 0.32 | 21.6 |
| 3-2 | 1100N 800T | | | | | | | | | | | | | | | |
| 3-3 | 1000Q 700T | | | | | | | | | | | | | | | |
| 3-4 | 1100Q 800T | | | | | | | | | | | | | | | |
| 4-1 | 1000N 700T | 0.10 | 0.32 | 0.51 | 0.02 | 2.26 | 0.05 | 1.54 | 0.03 | 0.05 | 0.01 | 0.80 | 0.01 | 0.02 | 0.55 | 24.2 |
| 4-2 | 1100N 800T | | | | | | | | | | | | | | | |
| 4-3 | 1000Q 700T | | | | | | | | | | | | | | | |
| 4-4 | 1100Q 800T | | | | | | | | | | | | | | | |
| 5-1 | 1000N 700T | 0.04 | 0.34 | 0.53 | 0.003 | 1.9 | 1.5 | 1.8 | 0.05 | 0.05 | 0.001 | 0.99 | 0.012 | 0.05 | 0.64 | 220.8 |
| 5-2 | 1100N 800T | | | | | | | | | | | | | | | |
| 5-3 | 1000Q 700T | | | | | | | | | | | | | | | |
| 5-4 | 1100Q 800T | | | | | | | | | | | | | | | |
| 6-1 | 1000N 700T | 0.15 | 0.5 | 0.6 | 0.003 | 2.6 | 1.5 | 1.8 | 0.4 | 0.1 | 0.1 | 1 | 0.015 | 0.06 | 0.65 | 37.375 |
| 6-2 | 1100N 800T | | | | | | | | | | | | | | | |
| 6-3 | 1000Q 700T | | | | | | | | | | | | | | | |
| 6-4 | 1100Q 800T | | | | | | | | | | | | | | | |

*In Table 1, heat treatment N means Normalizing, heat treatment Q means Quenching, and heat treatment T means Tempering, the numbers in front of alphabets mean temperatures at which heat treatment is performed. The normalizing/quenching and tempering heat treatment time was at least 30 minutes. A* represents a value calculated by Relational Expression 1, and B* represents a value calculated by Relational Expression 3.

Meanwhile, 'SUM', which is a content of impurity elements used in the calculation of Relational Expression 1-2, is composed of, in weight, a sum of Cu (0.004%), Co (0.003%), and other rare earth elements (0.003%), in the case of steel type 1, a sum of Cu (0.002%), Co (0.004%), and other rare earth elements (0.004%), in the case of steel type 2, a sum of Cu (0.003%), Co (0.02%), and other rare earth elements (0.007%), in the case of steel type 3, a sum of Cu (0.005%), Co (0.01%), and other rare earth elements (0.01%), in the case of steel type 4, a sum of Cu (0.015%), Co (0.01%), and other rare earth elements (0.01%), in the case of steel type 5, and a sum of Cu (0.01%), Co (0.015%), and other rare earth elements (0.01%), in the case of steel type 6.

TABLE 2

| Steel type No. | Microstructure | Temperature(° C. ) | Stress(MPa) | Fracture time(h), LMP | Reduction in area(%) |
|---|---|---|---|---|---|
| 1 (Comparative Example) | Tempered bainite 100% | 600 | 250 | Immediate fracture when stress is applied | |
| | | 600 | 225 | Immediate fracture when stress is applied | |
| | | 600 | 200 | 196, 19464.483 | 6.7 |
| | | 600 | 175 | 861, 20025.7 | 15.2 |
| | | 600 | 150 | 3367, 20542.81 | 10 |
| | | 600 | 125 | 6427, 20787.962 | 17.6 |
| 2-1(Inventive Example) | Tempered bainite 100% | 600 | 275 | 214, 19497.8 | 20 |
| | | 600 | 250 | 403, 19737.822 | 21.3 |

TABLE 2-continued

| Steel type No. | Microstructure | Temperature(° C. ) | Stress(MPa) | Fracture time(h), LMP | Reduction in area(%) |
|---|---|---|---|---|---|
| 2-2(Inventive Example) | Tempered bainite 100% | 600 | 275 | 300, 19625.9 | 22.5 |
| | | 600 | 250 | 369, 19704.4 | 23.2 |
| 2-3(Inventive Example) | Tempered martensite 100% | 600 | 275 | 258, 19568.71 | 21.7 |
| | | 600 | 250 | 446, 19776.27 | 21.8 |
| 2-4(Inventive Example) | Tempered martensite 100% | 600 | 275 | 272, 19588.74 | 20.8 |
| | | 600 | 250 | 442, 19772.85 | 25 |
| 3-1 (Inventive Example) | Tempered bainite 100% | 600 | 275 | 318, 19647.99 | 20.8 |
| | | 600 | 250 | 715, 19955.237 | 20 |
| | | 600 | 225 | 1381, 20204.86 | 21.7 |
| | | 600 | 200 | 2744, 20465.225 | 28 |
| | | 600 | 175 | 5494, 20728.48 | 20 |
| | | 600 | 150 | 13871, 21079.68 | 20.8 |
| | | 600 | 125 | 15490 (Test in progress), Pass21121.543 | |
| 3-2(Inventive Example) | Tempered bainite 100% | 600 | 275 | 360, 19695.04 | 20.3 |
| | | 600 | 250 | 588, 19881.08 | 22 |
| 3-3 (Inventive Example) | Tempered martensite 100% | 600 | 275 | 351, 19685.43 | 20.8 |
| | | 600 | 250 | 578, 19874.58 | 22.2 |
| 3-4 (Inventive Example) | Tempered martensite 100% | 600 | 275 | 343, 19676.69 | 22.8 |
| | | 600 | 250 | 629, 19906.64 | 21.5 |
| 4-1(Inventive Example) | Tempered bainite 100% | 600 | 275 | 408, 19742.5 | 20.8 |
| | | 600 | 250 | 553, 19857.81 | 21.7 |
| | | 600 | 225 | 1618, 20264.92 | 20.8 |
| | | 600 | 200 | 2656, 20452.865 | 26.4 |
| | | 600 | 175 | 5592, 20735.19 | 25 |
| | | 600 | 150 | 14726 (Test in progress), Pass 21102.36 | |
| | | 600 | 125 | 23302 (Test in progress), Pass21276.389 | |
| 4-2 (Inventive Example) | Tempered bainite 100% | 600 | 275 | 397, 19732.13 | 21.7 |
| | | 600 | 250 | 537, 19846.68 | 22 |
| 4-3(Inventive Example) | Tempered martensite 100% | 600 | 275 | 381, 19716.53 | 23.3 |
| | | 600 | 250 | 565, 19865.95 | 22.7 |
| 4-4(Inventive Example) | Tempered martensite 100% | 600 | 275 | 422, 19755.29 | 22.5 |
| | | 600 | 250 | 528, 19840.27 | 23.7 |
| 5-1 (Inventive Example) | Tempered bainite 100% | 600 | 275 | 269, 19584.54 | 50 |
| | | 600 | 250 | 1000 (Test in progress), Pass20082.45 | |
| 5-2(Inventive Example) | Tempered bainite 100% | 600 | 275 | 291, 19614.35 | 46.7 |
| | | 600 | 250 | 1000 (Test in progress), Pass(break through?) 20082.45 | |
| 5-3 (Inventive Example) | Tempered martensite 100% | 600 | 275 | 354, 19688.66 | 48.3 |
| | | 600 | 250 | 1000 (Test in progress), Pass20082.45 | |
| 5-4 (Inventive Example) | Tempered martensite 100% | 600 | 275 | 241, 19542.86 | 43.3 |
| | | 600 | 250 | 1000 (Test in progress), Pass20082.45 | |
| 6-1(Inventive Example) | Tempered bainite 100% | 600 | 275 | 237, 19536.51 | 58.3 |
| | | 600 | 250 | 1000 (Test in progress), Pass20082.45 | |
| 6-2(Inventive Example) | Tempered bainite 100% | 600 | 275 | 347, 19681.09 | 53.3 |
| | | 600 | 250 | 1000 (Test in progress), Pass20082.45 | |
| 6-3(Inventive Example) | Tempered martensite 100% | 600 | 275 | 423, 19756.19 | 45 |
| | | 600 | 250 | 1000 (Test in progress), Pass 20082.45 | |
| 6-4(Inventive Example) | Tempered martensite 100% | 600 | 275 | 381, 19716.53 | 42.5 |
| | | 600 | 250 | 1000 (Test in progress), Pass20082.45 | |

As shown in Table 1-2 and FIG. 1, it is seen that the chromium-molybdenum steel sheet of the present disclosure had a better creep life than the ASTM A213 Grade 91 and 92 steel materials including 9 wt % of Cr. In addition, it is confirmed that steel types 2 to 4 satisfying the steel composition components of the present disclosure had better creep properties than steel type 1 which did not satisfy the steel composition components of the present disclosure. In particular, steel types 5 and 6 have a much longer creep life compared to steel types 2 to 4. Specifically, the steel types 5 and 6 exhibit excellent creep deformation suppression ability at a temperature of 600° C. and an applied stress of 250 MPa, and even after 100 hours, it can be seen that the steel types 5 and 6 withstand high temperature and applied stress.

FIG. 2 shows creep strain with time measured at a temperature of 600° C. and an applied stress of 125 MPa for steel types 1, 3-1, and 4-1. In the case of steel type 1, which is a Comparative example, creep deformation occurred quickly and finally creep was fractured in 6427 hours, but in the case of steel types 3-1 and 4-1, which are Inventive examples, it can be seen that creep deformation suppression ability was shown, compared to steel type 1, and it withstands high temperature and applied stress even after tens of thousands of hours.

FIG. 3 is a scanning electron microscope photograph showing a result of observing the microstructure of steel type 1 and 4-1 steel sheet being reheated at 1000° C. for 30 minutes, and then normalized to be cooled to room temperature, following by being tempered at 700° C. for 30 minutes, and FIG. 4 is a transmission electron micrograph showing a distribution of precipitates in steel types 1 and 4-1.

As an Inventive Example, all of steel type 4-1 showed precipitation of only fine carbonitride in grains and along sub-grain boundaries. It can be seen that creep strength properties are greatly improved compared to the conventional chromium steel by effectively not only inhibiting dislocation movement at high temperature, but also effectively preventing movement of sub-crystal grains in steel types having martensite/bainite to secure stability, thereby significantly improving creep strength properties compared to the conventional chromium steel. That is, it can be seen that in all steel types including martensite and bainite, which are microstructures having sub-crystal grains, precipitating only fine carbonitrides is very effective in increasing a creep strength life.

In addition, steel types 5 to 6 seem to have increased creep strength due to not only the effect of fine carbonitride, but also the solid solution strengthening effect of additional molybdenum.

On the other hand, it can be seen that steel type 1 has poor creep strength properties compared to steel types 2 to 6 due to the formation of coarse $(Fe, Cr)_{23}C_6$ carbide.

In the case of high-temperature ductility, which can determine a probability of surface cracks during continuous casting or welding, when high-temperature ductility increases, the probability of surface cracking decreases. As shown in Table 2 and FIGS. 5 and 6, as the vanadium content, the nickel content, and the molybdenum contents increase, a reduction in area increases, so that the high-temperature ductility increases. It can be seen that vanadium prevents formation of $(Fe, Cr)_{23}C_6$ carbide coarsely formed at grain boundaries, and satisfies the Relational Expression 1 for steel grades 2-1 to 4-4 of the present Inventive Example, so that the reduction in area is 20% or more. In Inventive Example, steel types 5-1 to 6-4 have chemical compositions that simultaneously satisfy Relational Expressions 1 and 3, and accordingly, the reduction in area is 40% or more, showing very high ductility compared to other steel types. As a result, in the present disclosure, it can be confirmed that the steel manufactured suppressing formation coarse carbides, introducing fine carbonitrides, and using additional solid solution elements such as nickel and molybdenum, and manufactured according to the proposed heat treatment method, showing excellent high-temperature creep strength and high-temperature ductility.

The present disclosure is not limited to the exemplary embodiments and the examples, but may be made in various forms different from each other, and those skilled in the art will understand that the present disclosure may be implemented in other specific forms without departing from the spirit or essential feature of the present disclosure. Therefore, it should be understood that the above-mentioned exemplary embodiments and examples are illustrative but not restrictive in all aspects.

The invention claimed is:

1. A chromium steel sheet having excellent creep strength and high-temperature ductility comprising, in percentage by weight:

0.04 to 0.15% of C; 0.5% or less (excluding 0%) of Si; 0.1 to 0.6% of Mn; 0.01% or less (excluding 0%) of S; 0.03% or less (excluding 0%) of P; 1.9 to 2.6% of Cr; 0.05 to 1.5% of Mo; 1.4 to 2.0% of W; 0.4 to 1.0% of V; 0.4% or less (excluding 0%) of Ni; 0.10% or less (excluding 0%) of Nb; 0.10% or less (excluding 0%) of Ti; 0.015% or less (excluding 0%) of N; 0.06% or less (excluding 0%) of A1; 0.007% or less (excluding 0%) of B; and a balance being Fe and inevitable impurities, wherein the chromium steel sheet has a microstructure consisting of one of tempered martensite and tempered bainite, wherein in the microstructure of the chromium steel sheet, precipitates having a diameter of 200 nm or more including $(Fe, Cr)_{23}C_6$ exist in a number range of $1/\mu m^2$ or less, and wherein the chromium steel sheet satisfies Relational Expression 1, and has an LMP value defined by Relational Expression 2 of 20,000 or more at an applied stress of 200 MPa and 21,000 or more at an applied stress of 125 MPa, and a reduction in area at high temperature fracture is 20% or more, $$0.3 \leq (V-10SUM) \leq 1 \quad \text{[Relational Expression 1]}$$

where, SUM is a total content of specific impurity elements, specifically, Cu+Co+La+Y+Ce+Zr+Ta+Hf+Re+Pt+Ir+Pd+Sb, $$LMP = T \times (20 + \log(tr)) \quad \text{[Relational Expression 2]}$$

where, T is an absolute temperature in Kelvin units, and tr is a fracture time in time units.

2. The chromium steel sheet having excellent creep strength and high-temperature ductility of claim 1, wherein the steel sheet has a chemical composition satisfying Relational Expression 3, and at the same time, an LMP value defined by the Relational Expression 2 of 20,000 or more at an applied stress of 250 MPa, and a reduction in area at high temperature fracture of 40% or more, $$35 \leq |(V-10SUM) \times (Mo-10SUM) \times (Ni-10SUM) \times 10^3| \leq 600 \quad \text{[Relational Expression 3]}$$

where, SUM refers to a total content of specific impurity elements, specifically, the total content of Cu+Co+La+Y+Ce+Zr+Ta+Hf+Re+Pt+Ir+Pd+Sb.

3. The chromium steel sheet having excellent creep strength and high-temperature ductility of claim 1, wherein the number of precipitates having a diameter of 20 nm or less in a range of $20/\mu m^2$ or more in the microstructure of the steel sheet.

4. The chromium steel sheet having excellent creep strength and high-temperature ductility of claim 3, wherein the precipitates having the diameter of 20 nm or less are (V,Mo,Nb,Ti) (C,N).

5. The chromium steel sheet of claim 1, wherein the chromium steel sheet comprises 0.4 to 0.6% of Mn.

6. The chromium steel sheet of claim 1, wherein the chromium steel sheet comprises 2.1 to 2.5% of Cr.

7. The chromium steel sheet of claim 1, wherein the chromium steel sheet comprises 0.2 to 1.3% of Mo.

8. The chromium steel sheet of claim 1, wherein the chromium steel sheet comprises 1.5 to 1.8% of W.

9. The chromium steel sheet of claim 1, wherein the chromium steel sheet comprises 0.5 to 0.9% of V.

10. A method of manufacturing a chromium steel sheet having excellent creep strength and high-temperature ductility, the method comprising:

hot rolling a steel slab including, by weight, 0.04 to 0.15% of C, 0.5% or less (excluding 0%) of Si, 0.1 to 0.6% of Mn, 0.01% or less (excluding 0%) of S, 0.03% or less (excluding 0%) of P, 1.9 to 2.6% of Cr, 0.05 to 1.5% of Mo, 1.4 to 2.0% of W, 0.4 to 1.0% of V, 0.4% or less (excluding 0%) of Ni, 0.10% or less (excluding 0%) of Nb, 0.10% or less (excluding 0%) of Ti, 0.015% or less (excluding 0%) of N, 0.06% or less (excluding 0%) of Al, and 0.007% or less (excluding 0%) of B, and a balance of Fe and unavoidable impurities, the steel slab having a composition satisfying the Relational Expression 1, so that a finish rolling temperature is equal to or higher than Ar3 to manufacture a hot-rolled steel sheet, and then cooling the hot-rolled steel sheet;

reheating the cooled hot-rolled steel sheet in a temperature range of 1000° C. to 1100° C. for at least 30 minutes to austenitize the steel sheet;

normalizing or quenching the austenitized hot-rolled steel sheet to room temperature at a cooling rate of 0.1° C./s or more; and tempering the cooled hot-rolled steel sheet in a temperature range of 700 to 800° C. for at least 30 minutes so as to obtain the chromium steel sheet having a microstructure consisting of one of tempered martensite and tempered bainite, wherein an LMP value defined by the following Relational Expression 2 is 20,000 or more at an applied stress of 200 MPa and 21,000 or more at an applied stress of 125 MPa, and a reduction in area at high temperature fracture is 20% or more, $$0.3 \leq (V - 10\text{SUM}) \leq 1 \quad \text{[Relational Expression 1]}$$

where, SUM is a total content of specific impurity elements, specifically, Cu+Co+La+Y+Ce+Zr+Ta+Hf+Re+Pt+Ir+Pd+Sb, $$LMP = T \times (20 + \log(tr)) \quad \text{[Relational Expression 2]}$$

where, T is an absolute temperature in Kelvin units, and tr is a fracture time in time units.

11. The method of manufacturing a chromium steel sheet having excellent creep strength and high-temperature ductility of claim 7, wherein the steel slab has a chemical composition satisfying the following relational expression 3, and the manufactured chromium steel sheet has an LMP value defined by the above relational expression 2 of 20,000 or more at an applied stress of 250 MPa, and a reduction in area at high temperature fracture of 40% or more, $$35 \leq |(V - 10\text{SUM}) \times (Mo - 10\text{SUM}) \times (Ni - 10\text{SUM}) \times 103| \leq 600 \quad \text{[Relational Expression 3]}$$

where, SUM is a total content of specific impurity elements, specifically, Cu+Co+La+Y+Ce+Zr+Ta+Hf+Re+Pt+Ir+Pd+Sb.

* * * * *